US007181155B2

(12) United States Patent
Aoki et al.

(10) Patent No.: US 7,181,155 B2
(45) Date of Patent: Feb. 20, 2007

(54) DEVELOPER SUPPLYING DEVICE, DEVELOPING ROLLER, DEVELOPING DEVICE, IMAGE FORMING APPARATUS AND PROCESS CARTRIDGE

(75) Inventors: Katsuhiro Aoki, Yokohama (JP); Hajime Oyama, Ichiwaka (JP); Hiroshi Ikeguchi, Saitama (JP); Yasuo Miyoshi, Yokohama (JP); Hiromitsu Takagaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 63 days.

(21) Appl. No.: 11/169,807

(22) Filed: Jun. 30, 2005

(65) Prior Publication Data

US 2006/0002744 A1 Jan. 5, 2006

(30) Foreign Application Priority Data

Jun. 30, 2004 (JP) ..... 2004-195003

(51) Int. Cl.
*G03G 15/08* (2006.01)

(52) U.S. Cl. ..... 399/258; 399/265; 399/279; 399/281; 399/285; 399/286

(58) Field of Classification Search ..... 399/258, 399/260, 265, 279, 281, 284, 285, 286
See application file for complete search history.

(56) References Cited

U.S. PATENT DOCUMENTS 2,761,416 A * 9/1956 Carlson ..... 399/258
4,258,115 A * 3/1981 Magome et al. ..... 399/279
5,293,198 A 3/1994 Sawayama et al.
5,339,141 A 8/1994 Suzuki et al.
5,424,814 A 6/1995 Suzuki et al.
5,565,973 A 10/1996 Fujishiro et al.
5,634,181 A * 5/1997 Tachibana et al. ..... 399/281
5,655,193 A 8/1997 Fujishiro et al.
6,070,039 A * 5/2000 Yamaki et al. ..... 399/285
6,149,564 A * 11/2000 Nozawa et al. ..... 399/281
6,163,669 A 12/2000 Aoki et al.
6,196,958 B1 * 3/2001 Shiraki et al. ..... 399/281
6,295,437 B1 9/2001 Hodoshima et al.
6,463,244 B2 10/2002 Aoki et al.
6,505,014 B2 1/2003 Aoki et al.
6,526,248 B1 2/2003 Aoki et al.

(Continued)

FOREIGN PATENT DOCUMENTS

JP 05-232800 9/1993

(Continued)

OTHER PUBLICATIONS

U.S. Appl. No. 11/395,186, filed Apr. 3, 2006, Miyoshi.

*Primary Examiner*—David M. Gray
*Assistant Examiner*—Laura K Roth
(74) *Attorney, Agent, or Firm*—Oblon, Spivak, McClelland, Maier & Neustadt, P.C.

(57) ABSTRACT

A developer supplying device including a developer holding unit configured to hold a developer, a developer transfer device configured to electrostatically transfer the developer from the developer holding unit, and a charging member having holes piercing therethrough from the developer holding unit, to abrasively charge the developer by contacting the developer with walls of the holes while the developer is electrostatically transferred through the holes by the developer transfer device.

25 Claims, 11 Drawing Sheets

U.S. PATENT DOCUMENTS 6,608,984 B1 8/2003 Matsumoto et al.
6,658,227 B2 12/2003 Oyama et al.
6,721,516 B2 4/2004 Aoki et al.
6,788,913 B1 9/2004 Aoki et al.
6,816,694 B2 * 11/2004 Adachi et al. ..... 399/265
6,862,419 B2 * 3/2005 Cho et al.
7,123,864 B2 * 10/2006 Miyaguchi et al. ..... 399/258
2004/0223792 A1 * 11/2004 Aoki et al. ..... 399/281
2005/0111886 A1 * 5/2005 Kawano ..... 399/281

FOREIGN PATENT DOCUMENTS

JP 09-085741 3/1997

* cited by examiner

CHANGES IN THE AMOUNT OF CHARGE

TRANSITION OF EMBEDDING RANKING OF TONER ADDITIVE

DEVELOPER SUPPLYING DEVICE, DEVELOPING ROLLER, DEVELOPING DEVICE, IMAGE FORMING APPARATUS AND PROCESS CARTRIDGE

BACKGROUND OF THE INVENTION

1. Field of the Invention

The present invention relates to a developer supplying device, a developing roller, a developing device, an image forming apparatus and a process cartridge.

2. Discussion of the Background

A developing device 200 illustrated in FIG. 14 has been used as a single component developer system using a single component developer. Such a single component developer contains a toner. This developing device 200 includes a developing roller 208 formed of an elastic body and a developer supplying roller 206, which is abrasively in contact with the developing roller 208, to supply a developer (i.e., toner) 204 thereto. In addition, the developing device 200 further includes a layer thickness regulating member 207, a developer holding unit 203 to hold the developer, and an agitator 205 functioning as an agitating member. The layer thickness regulating member 207 is in contact with the developing roller 208 to reduce the thickness of the developer layer on the developing roller 208. The agitator 205 supplies the developer to the surface of the developer supplying roller 206 while stirring the developer in the developer holding unit 203.

In this developing device 200, the developer 204 held in the developer holding unit 203 is agitated by the agitator 205 and mechanically supplied to and borne on the surface of the developer supplying roller 206. The developer supplying roller 206 bears and transfers the developer 204 at a portion opposing the developing roller 208 while the developer supplying roller is in abrasive contact with the developing roller 208. The developer 204 supplied to the developing roller 208 forms a developer layer on the surface thereon and the thickness of the developer layer is suitably regulated by the layer thickness regulating member 207. In addition, the developer 204 is friction-charged with a desired polarity and is transferred at a portion opposing an image bearing member 1, i.e., the developing area, by the rotation of the developing roller 208 in the direction indicated by the arrow in FIG. 14.

However, in the developing device 200 as illustrated in FIG. 14, the developer 204 is mechanically agitated by the agitator 205 and transferred to the developer supplying roller 206. Therefore, the developer 204 is mechanically stressed by the agitator 205. In addition, in the developing device 200, the layer thickness regulating member 207 is in contact with the developing roller 208 with a high pressure to abrasively charge the developer 204 to a desired polarity. Thereby, the developer 204 receives significant mechanical stress when the developer 204 passes the layer thickness regulating member 207.

Typically, inorganic additives are attached around the mother binder resin of a toner to improve fluidity thereof. These additives sink in the mother binder resin by the mechanical stress mentioned above, resulting in deterioration of the fluidity of the toner. Therefore, the toner agglomerates and the amount of charge in the toner decreases, which has an adverse impact such as background fouling and poor toner supply.

In an image forming apparatus including the developing device using a single component developer mentioned above, the toner easily deteriorates and it is thus difficult to obtain images having good quality over an extended period of time. Further, since the toner supplying roller and the regulating member are in abrasive contact with the developing roller, the developing roller is abraded and toner attachment, i.e., filming, occurs. Consequently, it is difficult to maintain the durability of the developing device over an extended period of time.

Published unexamined Japanese Patent Application No. (hereinafter referred to as JOP) H05-232800 describes a technology in which a toner transferred from a transfer screw is supplied to a fur brush and further transferred to the outer surface of the developing roller by the rotation of the fur brush. The toner is abrasively charged with the inner wall of the casing and the fur brush while the toner is transferred by the fur brush. Thereby, the charged toner is supplied to the surface of the developing roller. That is, the toner is abrasively charged by the rotation of the fur brush during transfer. Thereby, the mechanical stress on a toner can be relatively small in comparison with that in a method for a typical developing device in which a toner is abrasively charged when the toner passes between a layer thickness regulating member and a developing roller that are in contact under a high pressure.

However, since the toner is transferred by the rotation of a fur brush, meaning that the toner is transferred with a mechanical stress, the toner possibly deteriorates due to the mechanical stress from the fur brush.

SUMMARY OF THE INVENTION

Because of these reasons, the present inventors recognized that a need exists for a developer supplying device, a developing roller, a developing device, an image forming apparatus, and a process cartridge that can obtain quality images over an extended period of time by restraining the mechanical stress on a developer when the toner is charged.

Accordingly, an object of the present invention is to hereby provide a developer supplying device, a developing roller, a developing device, an image forming apparatus, and a process cartridge that can obtain quality images over an extended period of time by restraining the mechanical stress on a developer when the toner is charged.

Briefly, this object and other objects of the present invention as hereinafter will become more readily apparent can be attained by a developer supplying device including a developer holding unit configured to hold a developer, a developer transfer device configured to electrostatically transfer the developer from the developer holding unit, and a charging member having plural holes piercing therethrough from the developer holding unit and configured to abrasively charge the developer by contacting the developer with walls of the holes while the developer is electrostatically transferred through the holes by the developer transfer device.

In a preferred embodiment, in the developer supplying device mentioned above, the charging member has a roller form, and the developer holding unit and the developer transfer device are provided internally to the charging member.

In a preferred embodiment, the developer supplying device further includes a rotation device to rotate the charging member.

In a preferred embodiment, in the developer supplying device mentioned above, the developer is supplied to the developer holding unit by a powder pump.

In a preferred embodiment, in the developer supplying device mentioned above, the developer contains a toner having an average circularity of from 0.96 to 1.0.

In a preferred embodiment, in the developer supplying device mentioned above, the charging member is an open cell foam in which the cells disposed internally to the charging member are linked to each other.

In a preferred embodiment, in the developer supplying device mentioned above, the number of the open cells in the open cell foam is from 6 to 23 cells/25 mm.

In a preferred embodiment, in the developer supplying device mentioned above, the ratio (dm/dt) of the diameter (dm) of the holes to the diameter (dt) of the developer is greater than 100.

In a preferred embodiment, the developer supplying device mentioned above further includes partitions separating the open cell foam such that the partitions radially extends from the developer holding unit.

In a preferred embodiment, in the developer supplying device mentioned above, the open cell foam is formed of an electroconductive member.

As another aspect of the present invention, a developing roller is provided which includes a developer supplying device to supply a developer, and one of a development layer and a sleeve located overlying the charging member to receive the developer electrostatically transferred through the developer supplying device. The developer supplying device includes a developer holding unit to hold the developer, a developer transfer device to electrostatically transfer the developer from the developer holding unit, and a charging member having plural holes piercing therethrough to abrasively charge the developer by contacting the developer with walls of the holes while the developer is electrostatically transferred through the holes by the developer transfer device.

As another aspect of the present invention, a developing device is provided which includes a developing roller, a developer supplying device to supply a developer, and a layer thickness regulating member to regulate the thickness of a developer layer on the developing roller. The developer supplying device includes a developer holding unit to hold the developer, a developer transfer device to electrostatically transfer the developer from the developer holding unit, and a charging member having plural holes piercing therethrough to abrasively charge the developer by contacting the developer with walls of the holes while the developer is electrostatically transferred through the holes by the developer transfer device.

In a preferred embodiment, in the developing device mentioned above, the charging member has a roller form and is provided internally to the developing roller, and the developer holding unit and the developer transfer device are provided internally to the charging member. The developing roller further includes one of a development layer and a sleeve located overlying the charging member to receive the developer electrostatically transferred through the charging member.

As another aspect of the present invention, an image forming is provided which includes an image bearing member to bear a latent electrostatic image thereon, a charging member to charge the image bearing member, an irradiator to irradiate the image bearing member to form the latent electrostatic image on the image bearing member, a developing device to develop the latent electrostatic image with a developer, a transfer device to transfer the developed image to a recording material, and a cleaning device to remove residual toner on the image bearing member. The developing device includes a developing roller, a developer supplying device to supply a developer and a layer thickness regulating member to regulate the thickness of a developer layer on the developing roller. Further, the developer supplying device includes a developer holding unit to hold the developer, a developer transfer device to electrostatically transfer the developer from the developer holding unit, and a charging member having plural holes piercing therethrough to abrasively charge the developer by contacting the developer with walls of the holes while the developer is electrostatically transferred through the holes by the developer transfer device.

As another aspect of the present invention, a process cartridge is provided which includes an image bearing member to bear a latent electrostatic image thereon and a developing device to develop the latent electrostatic image borne on the image bearing member. The developing device includes a developing roller, a developer supplying device to supply a developer, and a layer thickness regulating member to regulate the thickness of a developer layer on the developing roller. The developer supplying device includes a developer holding unit to hold the developer, a developer transfer device to electrostatically transfer the developer from the developer holding unit, and a charging member having plural holes piercing therethrough to abrasively charge the developer by contacting the developer with walls of the holes while the developer is electrostatically transferred through the holes by the developer transfer device.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
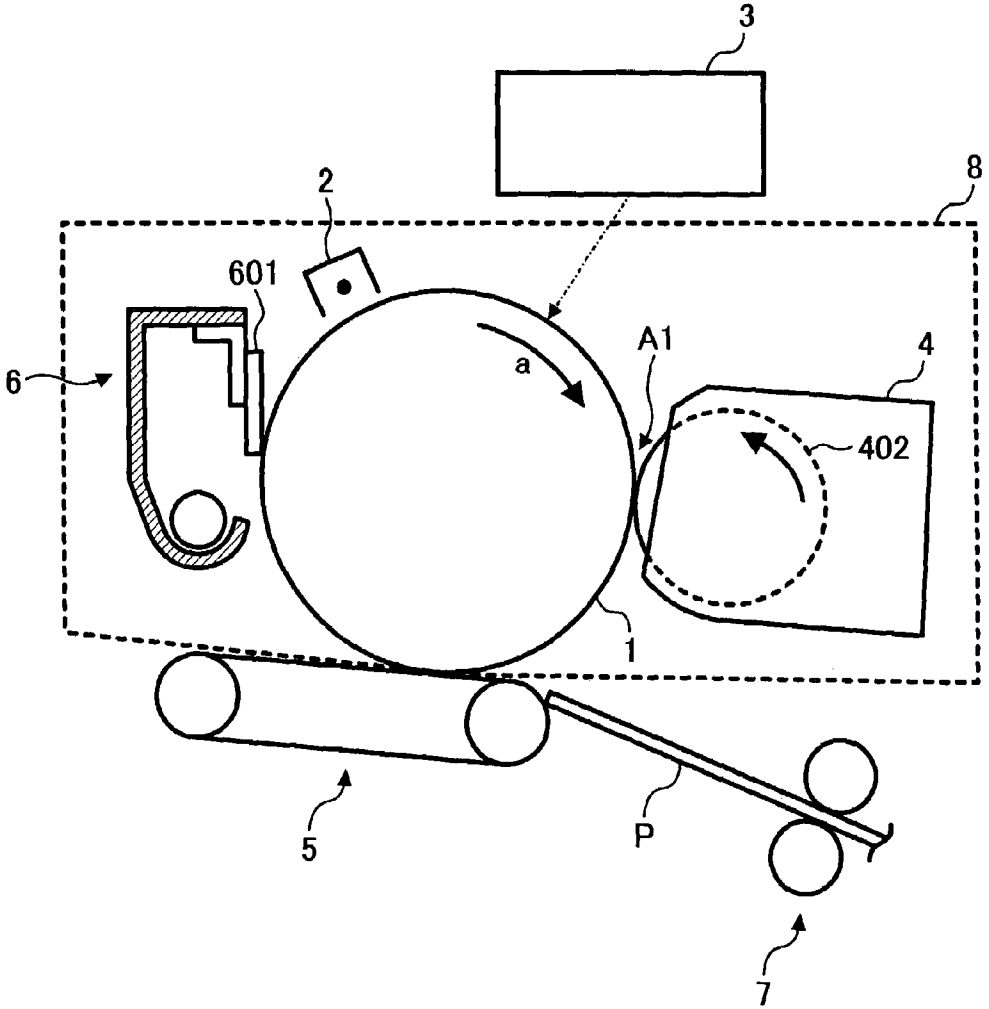
FIG. 1 is a schematic diagram illustrating an example of an image forming apparatus of the present invention.

FIG. 1 is a schematic diagram illustrating an example of an image forming apparatus of the present invention. In this image forming apparatus, around a photoreceptor drum 1 functioning as a latent electrostatic image bearing member are provided a charging device 2 which uniformly charges the surface of the photoreceptor drum 1, an irradiator 3 which irradiates the photo receptor drum 1 with, for example, a laser beam modulated based on image information, a developing device 4 which forms a developer (i.e., toner) image by attaching a charged powder developer on a developing roller 402 to a latent electrostatic image formed on the photoreceptor drum 1, a transfer device 5 which transfers the developer image formed on the photoreceptor drum 1 to a transfer material P as a transfer material, a cleaning device 6 including a cleaning member 601 which removes the developer on the photoreceptor drum 1 remaining after transfer, etc. A latent image forming device which forms a latent electrostatic image on the photoreceptor drum 1 is formed by the charging device 2 and the irradiating device 3 mentioned above. Further, there are also provided a recording material feeding and transferring device (not shown) which feeds and transfers a recording material P from a recording material feeder (not shown) and a fixing device (not shown) which fixes a developer image transferred from the transfer device 5 on the recording material P.

In addition, part of the multiple devices forming the image forming apparatus can be detachably attached as an integrated unit to the main body of the image forming apparatus. For example, the image forming apparatus can have a detachable process cartridge 8 enclosed by dotted lines including the photo receptor drum 1, the charging device 2, the developing device 4, and the cleaning device 6 as an integral unit.

In the image forming apparatus having the structure mentioned above, the surface of the photoreceptor drum 1 rotating in the direction indicated by the arrow a is uniformly charged by the charging device 2 and then a laser beam modulated based on image information scans in the axis of the photo receptor drum 1. Thereby, a latent electrostatic image is formed on the photoreceptor drum 1. The developing device 4 develops the latent electrostatic image formed on the photoreceptor drum 1 by attaching a charged developer thereto in a developing area A1 to form a developer image. The recording material P is fed and transferred from the recording material feeding and transferring device (not shown) to the transfer portion where the photoreceptor drum 1 and the transfer device 5 oppose each other with a timing determined by a registration roller pair 7. The transfer device 5 imparts the recording material P with a polarity opposite to the polarity of the developer image on the photoreceptor drum 1. Thereby, the developer image formed on the photo receptor drum 1 is transferred to the recording material P. Then, the recording material P is detached from the photoreceptor drum 1, and transferred to the fixing device (not shown). The recording material P is discharged after the developer image is fixed. The surface of the photo receptor drum 1 is cleaned by the cleaning device 6 to remove the toner remaining on the photoreceptor drum 1 after the developer image is transferred by the transfer device 5.

Figure 2:
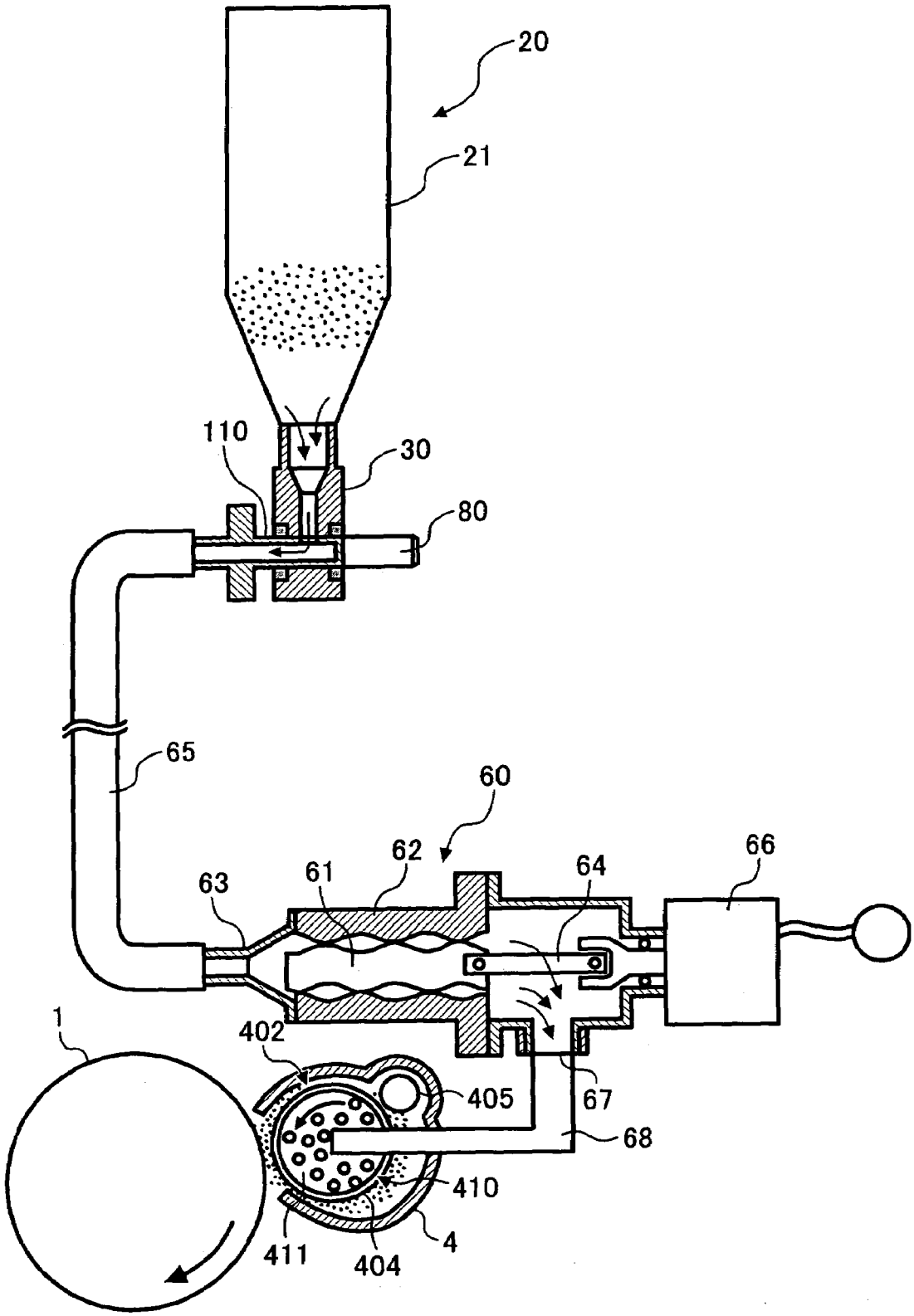
FIG. 2 is a diagram illustrating a developer replenishing system using a powder pump.

FIG. 2 is a cross section illustrating an example of the developer replenishing system using a powder pump. Numeral 20 represents a developer container containing a fresh developer. Numeral 80 represents an air inlet. The developer is a single component developer in this case, meaning that the developer is a toner. The developer container 20 includes a bag container 21 containing the developer, and a cap member 30. The cap member 30 is provided at the opening mouth of the bag container 21 and functions as an only outlet for discharging the developer in the bag container 21 to its outside.

The developer container 20 set in the image forming apparatus is linked with the developing device 4 by way of a developer supplying route. There are provided in this developer supplying route a nozzle 110 functioning as a connection member which is connected with the cap member 30, a powder pump 60 functioning as a suction member to transfer the toner in the container 20 to the developing device 4, and a developer transferring tube 65 which connects the nozzle 110 with the powder pump 60.

The developing device 4 includes a developing roller 402 and a layer thickness regulating member 405 in its casing. The developing roller 402 includes a developing sleeve 404 having a mesh form and a developer supplying device 410 including an open cell foam having a roller form to supply a developer to the developing sleeve 404. The developer supplying device 410 has a hollow center and one end of the hollow center is connected to one end of a developer supplying tube 68.

The powder pump 60 mentioned above is a one-axis screw pump including a rotor 61 and a stator 62 as its main members. The rotor 61 is formed by spirally twisting a hard axial member having a circular cross section. The rotor 61 is connected with a motor 66 with a universal joint 64 therebetween. The stator 62 is formed of a flexible rubber material and has a hole having a spirally twisted oval cross section. The spiral pitch of the stator 62 is twice as long as that of the rotor 61. The rotor 61 and the stator 62 are jointed such that a space is formed there between by rotating the rotor 61 so that the developer suctioned in the space can be transferred.

In the powder pump 60 as structured above, when the rotor 61 is rotationally driven, the developer contained in the developer container 20 is transferred into the powder pump 60 from a developer suction mouth 63. The developer is suctioned from left to right in FIG. 2 and supplied from a developer outlet 67 to the developing device 4 by way of the developer supplying tube 68. Since the developer is suctioned by the powder pump 60 to the toner holding unit 420 (see FIG. 4) included in the developer supplying device 410, the developer does not receive mechanical stress.

Figure 3:
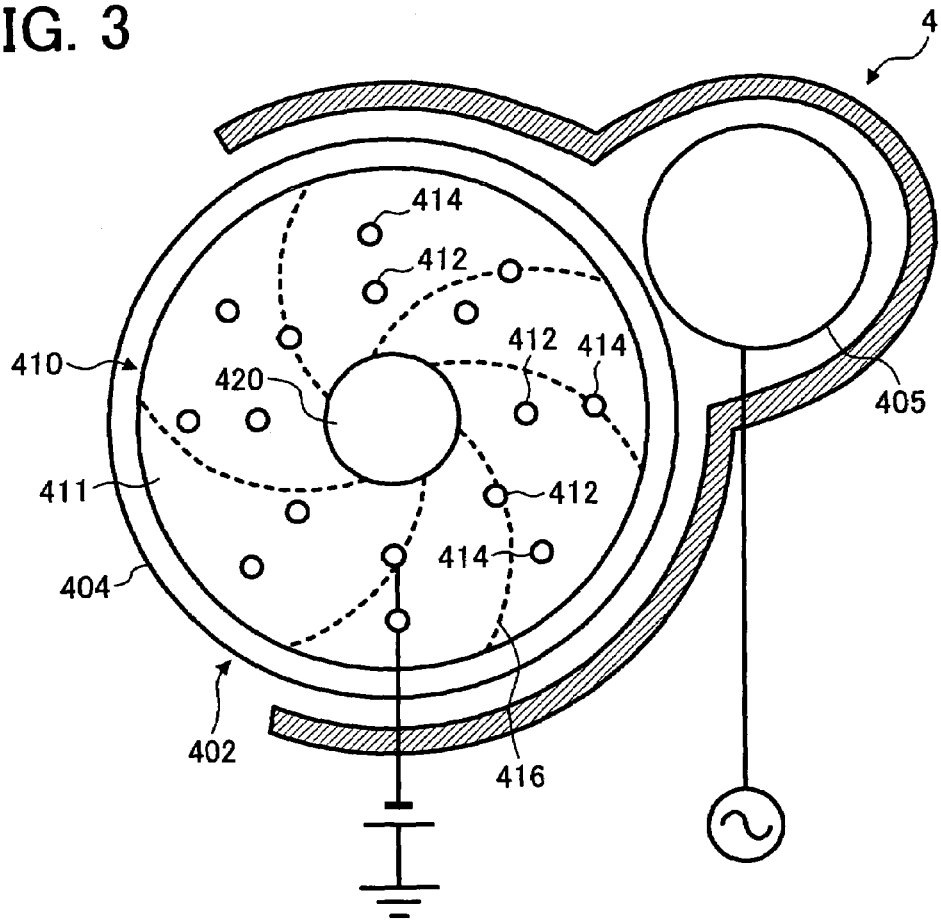
FIG. 3 is a cross section illustrating the developing device in its diameter direction.

FIG. 3 is a diagram illustrating the developing device 4 of the example described above. As illustrated in FIG. 3, the developing sleeve 404 has a mesh form with multiple discharging holes (not shown). The discharging holes have a diameter not greater than about 5 times as large as that of the developer. The developing sleeve 404 has a thickness of from 200 to 500 μm. To the developing sleeve 404 is applied a developing bias by a power source (not shown).

When the developing sleeve 404 is used in an extended period of time, the developer, etc., attaches to the surface of the developing sleeve 404, resulting in occurrence of developer filming. This is caused because the attachment force between the developer and the surface of the developing sleeve 404 increases and additives sink in the developer, resulting in deterioration of fluidity of the developer. Therefore, it is preferred that the developing sleeve 404 has a good releasablity against the developer and further a low electric resistance. Specific examples of such materials include resins and rubber containing silicone, acryl, polyurethane, etc. as a main component in which electroconductive materials are contained. In addition, these materials can be coated on the outer surface of the developing sleeve 404. Rubber is especially preferred to form the surface of the developing sleeve 404 because rubber is easy to wear down and the electric resistance of rubber is unchanged even when the rubber is worn. When the developing sleeve 404 is formed of rubber containing an electroconductive material, filming can be restrained by abrasively wearing the developing sleeve 404, i.e., the rubber. In addition, when the thickness of the rubber material reduces due to abrasion, the variance of the developing electric field between an image bearing member and the developing sleeve 404 is limited because the electric resistance of the rubber material varies only a little. Therefore, the deterioration of the quality of images can be restrained.

Specific preferred examples of such rubber materials include silicone, butadiene, nitrile rubber (NBR), hydrine, ethylenepropylene dienemethylene linkage (EPDM) rubber in which a known electroconductive material such as carbon black is dispersed. Electroconductive materials to impart electroconductivity to such rubber materials are, for example, known electroconductive materials such as carbon black.

The hollow portion in the center of the developer supplying device 410 is the developer holding unit 420. The diameter of the developer supplying device 410 is about 16 mm. The developer holding unit 420 has a diameter of about 10 mm. The developer supplying device 410 is formed of an open cell foam 411 functioning as a charging member in which cells in the open cell foam 411 are continuously linked to each other. The open cells extend through this open cell foam 411 from the toner holding unit 420 to the surface of the developer supplying device 410. Therefore, the developer supplied from the developer holding unit 420 can move to the surface of the. developer supplying device 410 through the open cells. Specific examples of this open cell foam 411 include foam resins such as polyurethane foam and their preferred marketed products. are, for example, HR-08 and HR20 (manufactured by Bridgestone Corporation). The number of the cells of the open cell foam 411 is preferably from 6 to 23 (cells/25 mm). When the number of the cells is too few, it is difficult for the developer to pass through the open cell foam 411. To the contrary, when the number of the cells is too many, the developer passes through the open cell foam 411 too easily such that the possibility of the developer contacting the walls of the cell foam decreases, and as a result it is difficult to charge the developer. In addition, the ratio (dm/dt) of the diameter (dm) of the cell foam of the open cell foam 411 to the diameter (dt) of the developer is preferably greater than 100. Specifically, the diameter of the cell foam is preferably from 50 to 500 μm. When the diameter of the cell foam is too small, it is difficult for the developer to pass through the open cell foam 411, resulting in clogging of the developer inside the open cell foam 411. In addition, the open cell foam 411 is made to be electroconductive to some extent, meaning that the specific volume resistance of the open cell foam 411 is about $10^7$ Ωcm. Therefore, when the walls of the open cell are abrasively charged by the contact with the developer, the amount of charge at the wall quickly decreases. Thus it is possible to prevent deterioration of the ability of charging the developer when the developer contacts with the walls of the cell foam.

In addition, pieces of a first electroconductive wire 412, e.g., eight pieces, are provided in the open cell foam 410 in a penetrating manner in the axis direction thereof with the same interval on the circumference of 12 mm from the center of the developer supplying device 410. Further, pieces of a second electroconductive wire 414, e.g., eight pieces, are provided in the same manner as the first electroconductive wire 412 except that the second electroconductive wire 414 is disposed on the circumference of 14 mm from the center of the developer supplying device 410. These electroconductive wires 412 and 414 are preferably a metal such as copper, nickel and iron having a diameter of from 0.1 to 1 mm. In addition, a transfer bias having a polarity reversed to the polarity of the developer is applied to the electroconductive wires 412 and 414 by a power source (not shown). The absolute value of the transfer bias applied to the second electroconductive wire 414 is greater than that applied to the first electroconductive wire 412. Since a voltage is applied to respective electroconductive wires 412 and 414, the developer supplied to the developer holding unit 420 can be electrostatically transferred to the surface of the developer supplying device 410. Further, when a developer having a specific volume resistance lower than that of the open cell foam 411 is attached to the electroconductive wires 412 and 414, the electric current thereof may leak to the developer supplying device 410 via the developer. Thus, a material having a specific volume resistance comparable to that of the open cell foam 411 is preferably applied to the electroconductive wires 412 and 414 to prevent such a leak. Specific examples of such coating materials include resins such as silicone containing resins and TEFLON® containing resins. Further, when these electroconductive wires 412 and 414 have a mesh form, these electroconductive wires 412 and 414 do not interrupt transferring the developer so that the developer can be smoothly transferred to the surface of the developer supplying device 410. Further, the open cell foam 411 is separated into, e.g., six sections by partition walls 416 having a significantly circular form. In addition, the surface of the developer supplying device 410 is preferably formed of the material used to form the surface of the developing roller 402 for use in typical single component developing. Specific examples of such materials include resins such as silicone resins and urethane resins.

Figure 4:
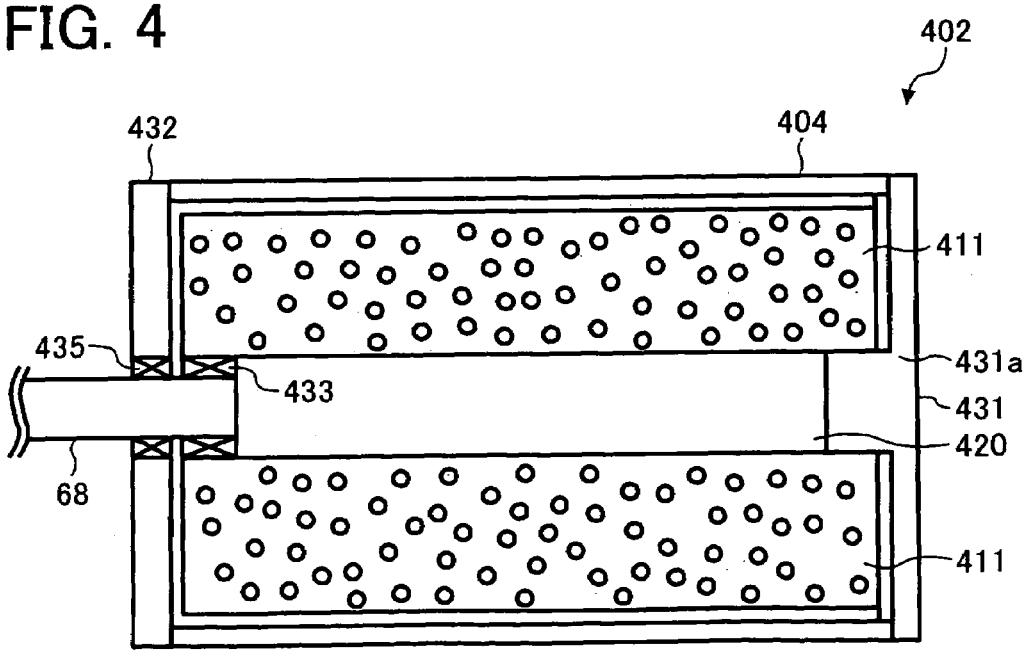
FIG. 4 is a cross section illustrating the developing device in its axis direction.

FIG. 4 is a cross section illustrating the developing roller 402 in its axis direction. As illustrated in FIG. 4, a protruding portion 431*a* of a first supporting member 431 is inserted into an end of the developer holding unit 420. The other end of the developer holding unit 420 is fixed to the developer supplying device 410 with the developer supplying tube 68 and a first bearing member 433 therebetween. One end of the developing sleeve 404 is fixed to the first supporting member 433 while the other end thereof is fixed to a second supporting member 432. The second supporting member 432 is fixed to the developer supplying tube 68 with a second bearing member 435 therebetween. A driving source (not shown) is provided to the first supporting member 431. When the first supporting member 431 is rotated by the driving force of the driving source, the developing sleeve 404 and the developer supplying device 410 fixed to the first supporting member 431 rotate at the same speed.

The layer thickness regulating member 405 (FIG. 3) is provided with a gap of from 50 to 150 μm between the layer thickness regulating member 405 and the developing sleeve 404 and formed of an electroconductive material. Further, a suction bias is applied to the layer thickness regulating member 405 by a power supply (not shown) to electrostatically move the developer attached to the inner surface of the developing sleeve 404 to its outer surface.

The developer supplying system in this example is now described. The developer is supplied from the developer container 20 through the developer supplying tube 65 to the powder pump 60 by which the developer is further supplied to the developer holding unit 420 through the developer supplying tube 68.

The developer supplied to the developer holding unit 420 is replenished per cycle of image formation. The amount of the developer for use in one cycle of image formation is determined based on, for example, the image information read by a scanner.

The developer supplied from the developer container 20 is charged a little because of abrasion with the developer supplying tube 68. Therefore, the developer is electrostatically transferred in the open cell foam 411 by the transfer bias applied to the first electroconductive wire 412. Since the open cell foam 411 is a continuous cell foam, the open cell forms a complicated passage to the surface of the developer supplying device 410. Thus, the developer moving in the open cell foam 411 is not transferred to the surface of the developer supplying device 410 in a straight line. The developer naturally contacts with the wall of the open cell following such a complicated route during transferring to the surface of the developer supplying device 410. Since the developer is electrostatically transferred along a complicated route, the possibility of the contact with the wall of the open cell is high. Therefore, the developer is sufficiently charged while the developer is being transferred to the surface of the developer supplying device 410. In addition, since the developer supplying device 410 is rotated, the possibility of contacts between the developer and the wall of the open cells is further improved. Further, since the open cell foam 411 functioning as a charging member is formed by a material having a specific volume resistance of $10^7$ Ωcm, meaning that the wall of the open cell foam 411 is difficult to be charged, the developer is easily charged when the developer contacts with the wall of the open cell. Further, transfer of some developers is interrupted by the partition wall 416 extending in the normal line direction and thus the some developers are friction-charged when contacting with the partition wall 416 during transfer. Therefore the possibility of charging the developer is further improved so that the developer is securely charged. In addition, because of the partition wall 416, the developer is uniformly supplied to any portion of the surface of the developer supplying device 410.

The developer electrostatically transferred to the first electroconductive wire 412 by the function of the electric field of the first transfer bias is electrostatically transferred to the second electroconductive wire 414 by the function of the electric field of the second transfer bias. The second transfer bias has the same polarity as the first transfer bias and a larger absolute value than that of the first transfer bias. The developer is friction-charged upon contacting with the wall of the open cell while the developer is electrostatically transferred to the second electroconductive wire 414. The developer transferred to the second electroconductive wire 414 is electrostatically transferred to the surface of the developer supplying device 410 by the function of the electric field formed by the developing bias applied to the developing sleeve 404, which has the same polarity as the second transfer bias and a larger absolute value than that of the second transfer bias. The developer transferred to the surface of the developer supplying device 410 is sufficiently charged as the result of the contact with the wall of the open cell. In this example, it has been confirmed that the developer particle on the surface of the developer supplying device 410 is 80% charged as compared with the developer particle on the developing sleeve 404. Further, it has also been confirmed that the additives do not sink in the toner. Furthermore, reversely charged or uncharged developers are not observed on the surface of the developer supplying device 410.

The developer transferred to the surface of the developer supplying device 410 attaches to the inner circumference of the developing sleeve 404 by the function of the electric field of the developing bias applied to the developing sleeve 404 and moves together with the developing sleeve 404. A gap between the developer supplying device 410 and the developing sleeve 404 is hardly formed, and the gap is about 20 μm at maximum if the gap is formed. Since the developer supplying device 410 rotates together with the developing sleeve 404, the developer between the developer supplying device 410 and the developing sleeve 404 does not mechanically deteriorate therebetween.

The developer attached to the inner circumference of the developing sleeve 404 is transferred to the layer thickness regulating member 405 by the developing sleeve 405. A suction bias is applied to the layer thickness regulating member 405 and sucks up the developer attached to the inner circumference of the developing sleeve 404 from holes (not shown) of the developing sleeve 404 to transfer the developer to the outer circumference thereof. The suction bias varies depending on the gap between the outer circumference of the developing sleeve 404 and the layer thickness regulating member 405. When the gap is 150 μm, the suction bias is an alternate voltage of a sinusoidal wave or a square wave having a frequency of from 1 to 5 KHz under the condition that the difference voltage (Vpp) between the maximum voltage and the minimum voltage of the alternate voltage is about 500 V. When the suction bias has the same polarity as the developing bias and a larger absolute value than the developing bias, the developer attached to the inner circumference of the developing sleeve 404 is electrostatically attracted and transferred to the layer thickness regulating member 405 by the electric field formed by the suction bias. When the suction bias decreases to an absolute value less than that of the developing bias, the developer attached to the layer thickness regulating member 405 is electrostatically transferred to the outer circumference of the developing sleeve 404 by the function of the electric field of the developing bias. The amount of the developer attached to the outer circumference of the developing sleeve 404 is limited by the gap between the developing sleeve 404 and the layer thickness regulating member 405, resulting in formation of a thin layer of the developer having an amount of charge of from 10 to 30 μC/g and a thickness of from 0.4 to 0.8 $mg/cm^2$ based on the unit area.

The developer supplied to the developer holding unit 420 of the developer supplying device 410 is attached to the outer circumference of the developing sleeve 404 with a uniform thickness. The developer attached to the outer circumference of the developing sleeve 404 is transferred to and developed at the developing area where the photoreceptor drum 1 and the developing sleeve 404 are opposed to each other. The developer which has not been used for development is transferred again to the layer thickness regulating member 405. The layer thickness regulating member 405 adjusts the thickness of the layer of the developer and the developer is transferred to the developing area again. Some developers drop to the developer supplying device 410 through the holes (not shown) of the developing sleeve 404. Such developers are friction-charged again while contacting with the walls of the open cells of the developer supplying device 410 and are transferred to the inner circumference of the developing sleeve 404 and again to the outer circumference thereof by the suction bias of the layer thickness regulating member 405.

Since the layer thickness regulating member 405 is formed of an electroconductive material, when the developer on the developing sleeve 404 which has lost some of its amount of charge passes the gap between the developing sleeve 404 and the layer thickness regulating member 405, the developer increases its amount of charge during contact with the layer thickness regulating member 405. Therefore, the developer transferred to the developing area has a sufficient amount of charge.

Figure 5:
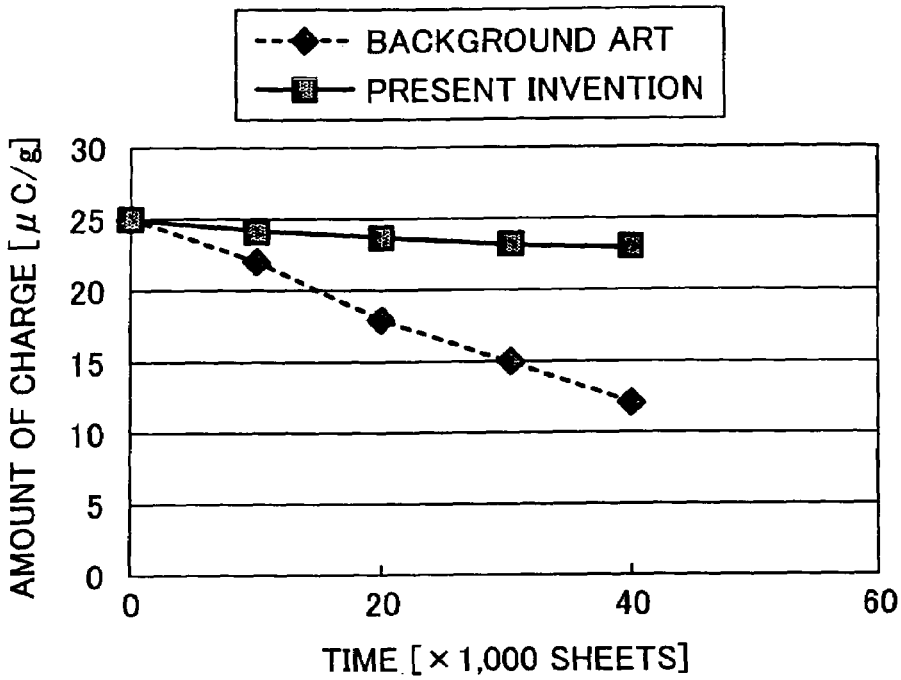
FIG. 5 is a graph illustrating a change in an amount of charge when using an example of the developing device of the present invention and when using a typical developing device.
Figure 14:
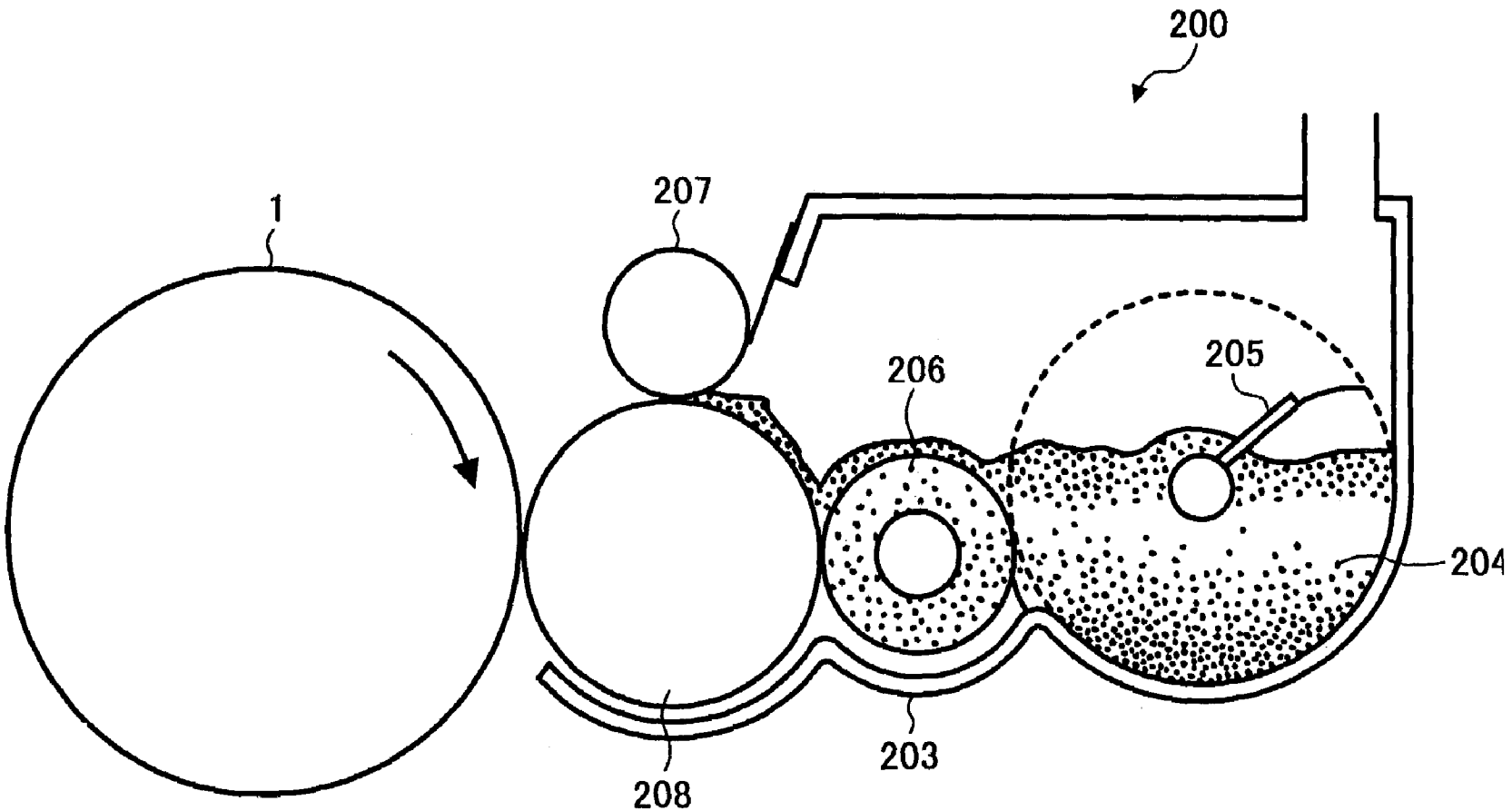
FIG. 14 BACKGROUND ART
FIG. 14 is a diagram illustrating a back ground developing device.

FIG. 5 is a graph illustrating the result of the comparison between the change in the amount of charge in the developer over time using the developing device 4 of this example and the change in the amount of charge in the developer over time using the developing device 200 of the background art illustrated in FIG. 14. As seen in FIG. 5, the result obtained when using the developing device 4 of this example is better than the result obtained when using the developing device 200 of the background art. In the developing device 200 of the background art, the developer is mechanically agitated by the agitator 205 to be charged to about 10% of the targeted amount of charge and transferred to the surface of the supplying roller 206. The developer attached to the surface of the developer supplying roller 206 is attracted to the developing roller 208 and contacts with the layer thickness regulating member 207 to be friction-charged to have a desired amount of charge. However, when the layer thickness regulating member 207 deteriorates over time and fails to fully charge a developer, an uncharged developer and insufficiently charged developer are transferred to the developing area. Consequently, the amount of charge in the developer reduces over time for the developing device 200 as seen in FIG. 5.

In contrast, the developing device 4 of this example electrostatically transfers a developer to the surface of the developer supplying device 410 while friction-charging the developer by contacting the developer with the walls of the open cells. Resultantly, the developer transferred to the surface of the developer supplying device 410 has 80% of the desired amount of charge. The developer having 80% of the desired amount of charge is electrostatically transferred and attached to the developing roller 402 and sufficiently charged by abrasively contacting with the layer thickness regulating member 405. Since, in the developing device 4, the developer is already charged to about 80% of the desired amount of charge before the developer is attached to the developing roller 402, a decrease in the amount of charge in the developer on the developer roller 402 can be restrained even when the layer thickness regulating member 405 deteriorates over time. In addition, since the developer is electrostatically transferred to the surface of the developing roller 402, an uncharged developer or insufficiently charged developer is not attracted to the surface of the developing roller 402. Therefore, the amount of charge in the developer used in the developing device 4 does not greatly change over time as seen in FIG. 5.

Figure 6:
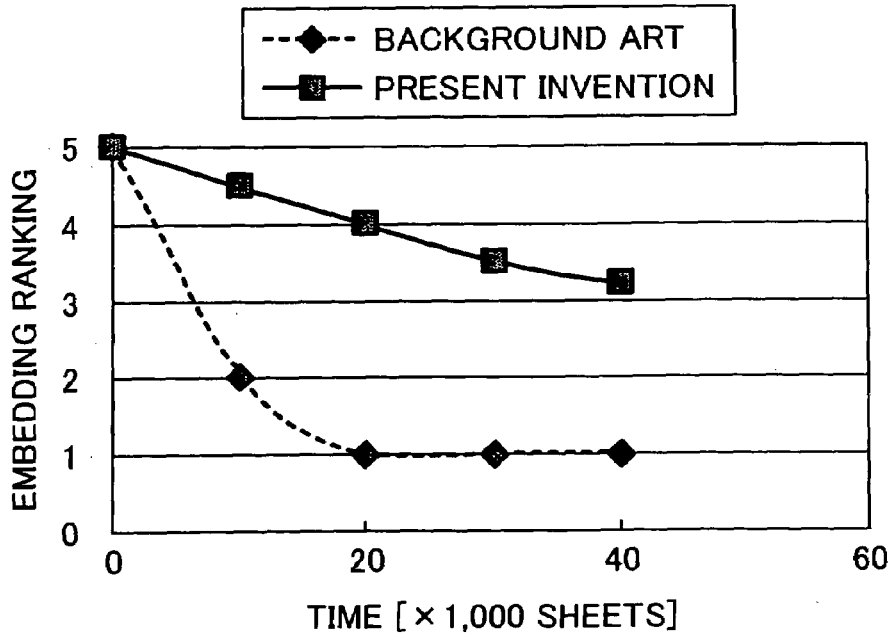
FIG. 6 is a graph illustrating a degree of additives sinking in the developer when using an example of the developing device of the present invention and when using a typical developing device.

FIG. 6 is a graph illustrating the result of the comparison between the degree of sinking of additives in a developer over time using the developing device 4 of this example and the degree of sinking of additives in a developer over time using the developing device 200 of the background art illustrated in FIG. 14. As seen in FIG. 6, the additives to the developer used in the developing device 4 do not sink in the developer as compared with these used in the developing device 200. The developing device 200 supplies the developer contained in the developer holding unit 203 to the surface of the developer supplying roller 206 by mechanically agitating the developer with the agitator 205. Therefore, the developer is under mechanical stress of the agitator 205 so that additives are embedded in the developer at an early stage.

By contrast, the developing device 4 of this example electrostatically supplies and transfers the developer contained in the developer holding unit 420 to the surface of the developer supplying device 410 by the function of the electric fields formed by the transfer bias applied to the first electroconductive wire 412 and the second electroconductive wire 414 and the developing bias applied to the developing sleeve 404. Since the developer is electrostatically supplied to the surface of the developer supplying device 410, the additives tend not to sink in the developer. It is therefore considered that the developing device 4 obtains a better result than the developing device 200 as seen in FIG. 6.

Figure 7:
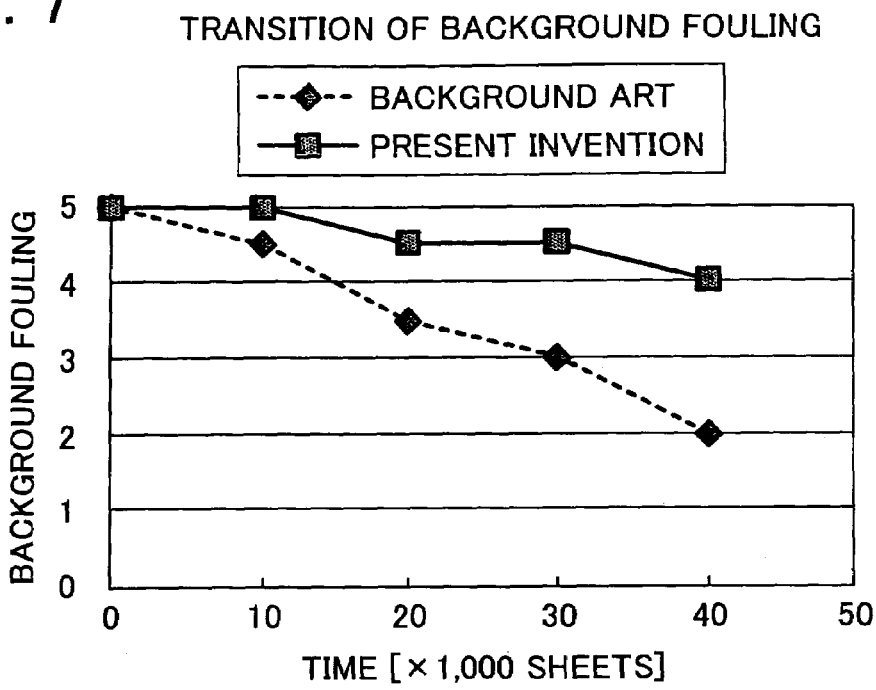
FIG. 7 is a graph illustrating a change in a degree of background fouling over time when using an example of the developing device of the present invention and when using a typical developing device.

FIG. 7 is a graph illustrating the result of the comparison between the degree of background fouling observed in obtained images over time when using the developing device 4 of this example and the degree of background fouling observed in obtained images over time when using the developing device 200 of the background art illustrated in FIG. 14. As seen in FIG. 7, the developing device 4 obtains a better result than the developing device 200. This is thought to be because the change in the amount of charge in the developer over time and the change in the degree of sinking of additives in the developer over time are less when the developing device 4 is used than when the developing device 200 of the background art is used.

The developing roller 402 in this example includes the developer supplying device 410, the developer holding unit 420, and the developing sleeve 404. Further, a developing roller including an open cell foam functioning as a charging member and a developing layer can also be used. In this structure, the developing layer is formed of resins or rubber mainly formed of silicone, acryl, polyurethane, etc. in which electroconductive materials are contained and accumulated on the surface of the open cell foam. In addition, multiple holes having a diameter not greater than 5 times the diameter of the developer are provided to the developing layer. Further, the open cell foam functioning as a charging member is structured in the same manner. That is, the open cell foam includes partition walls dividing the open. cell foam into, e.g., six sections and a first and a second electroconductive wire applied to the transfer bias.

VARIANT EXAMPLE 1

Figure 8:
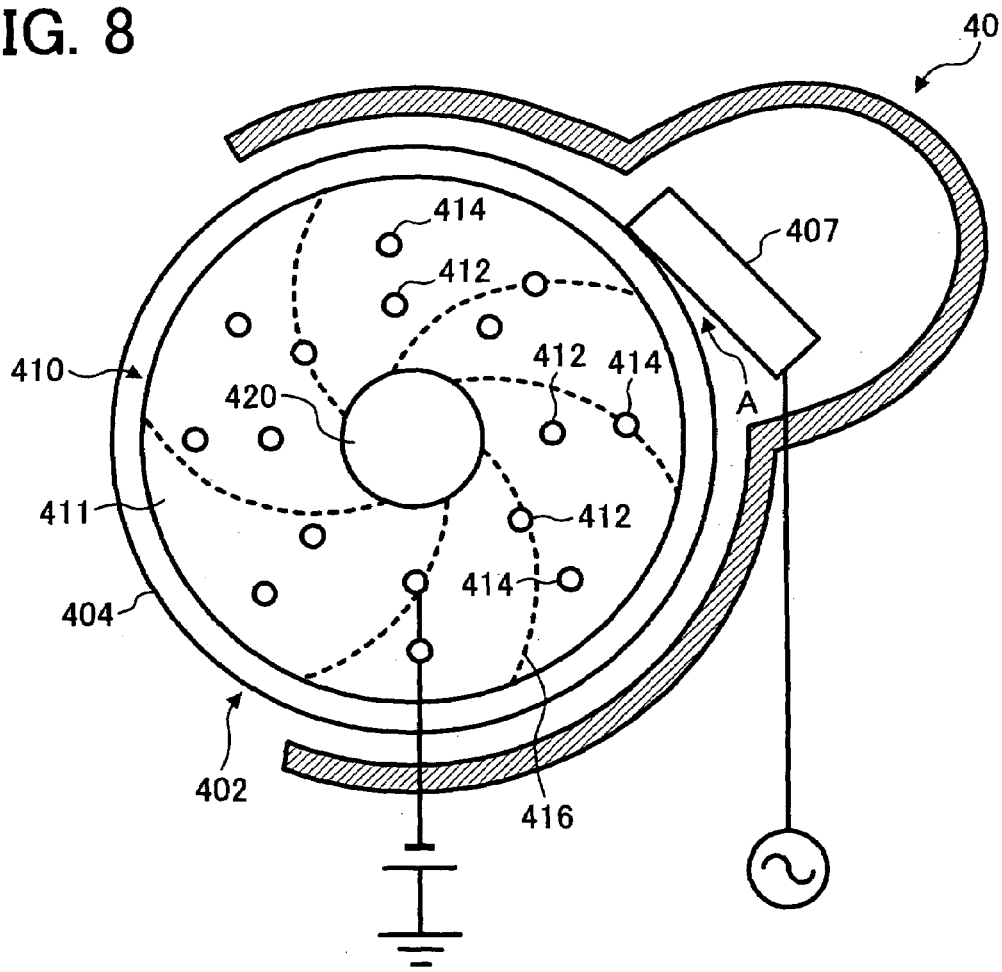
FIG. 8 is a cross section illustrating an example of a developing device of the present invention.

Next, a Variant Example 1 is described. FIG. 8 is a diagram illustrating a developing device 40 of Variant Example 1. In the developing device 40, as illustrated in FIG. 8, a layer thickness regulating blade 407 is structured such that the layer thickness regulating blade 407 is in contact with the developing sleeve 404. This layer thickness regulating blade 407 is fixed to a holder (not shown) and has a free end having a length of from 10 to 15 mm. When the length of the free end of the layer thickness regulating blade 407 is too long, the developing device 40 increases in size. In contrast, when the length of the free end of the layer thickness regulating blade 407 is too short, the free end tends to vibrate when the free end contacts with the surface of the developing sleeve 404, resulting in occurrence of uneven stepping patterns on an image. It is preferred that the contact pressure of the layer thickness regulating blade 407 is from 0.049 to 2.45 Ncm. When the contact pressure is too large, the amount of the developer attached to the developing sleeve 404 after the layer thickness regulating blade 407 passes decreases and the amount of charge in the developer excessively increases. Thus the amount of the developer used for developing an image reduces, resulting in a decrease in the density thereof. When the contact pressure is too small, the layer formed is not uniform. Therefore, a lump of the developer possibly passes the layer thickness regulating blade 407, resulting in extreme deterioration in the image quality. It is preferred that the contact angle of the layer thickness regulating blade 407 is from 10 to 45° against the tangent line of the developing sleeve 404 with the front end pointing toward the downstream of the developing sleeve 404.

A suction bias, which has the same polarity as a developing bias applied to the developing sleeve 404 and is larger than the developing bias in absolute value, is applied to the layer thickness regulating blade 407. The developer friction-charged by contact with the walls of the open cells while being transferred from the toner holding unit 420 attaches to the inner circumference of the developing sleeve 404. Thereafter the developer is transferred by the developing sleeve 404 to an nipping area A which is formed between the layer thickness regulating blade 407 and the developing sleeve 404. At the nipping area A, the developer moves out of the holes on the developing sleeve 404 to the outer circumference thereof by the electric field of the suction bias. Thereby, the developer is pooled at the nipping area A. A portion of the pooled developer passes through the layer thickness regulating blade 407 and forms a thin layer. In the developing device 40 of Variant Example 1, the developing sleeve 404 has a hardness of 30° based on JIS-A, the layer thickness regulating blade 407 is a SUS blade having a thickness of 0.1 mm, and the contact pressure is 60 gf/cm. Thereby, the thin layer formed after the developer passes through the layer thickness regulating blade 407 can have a uniform thickness of from 0.4 to 0.8 mg/cm$^2$ per unit area. The amount of charge in the developer is from −10 to −30 μC/g. The suction bias applied to the layer thickness regulating blade 407 is a direct current voltage in this case but an alternate voltage is also allowed.

VARIANT EXAMPLE 2

Figure 9:
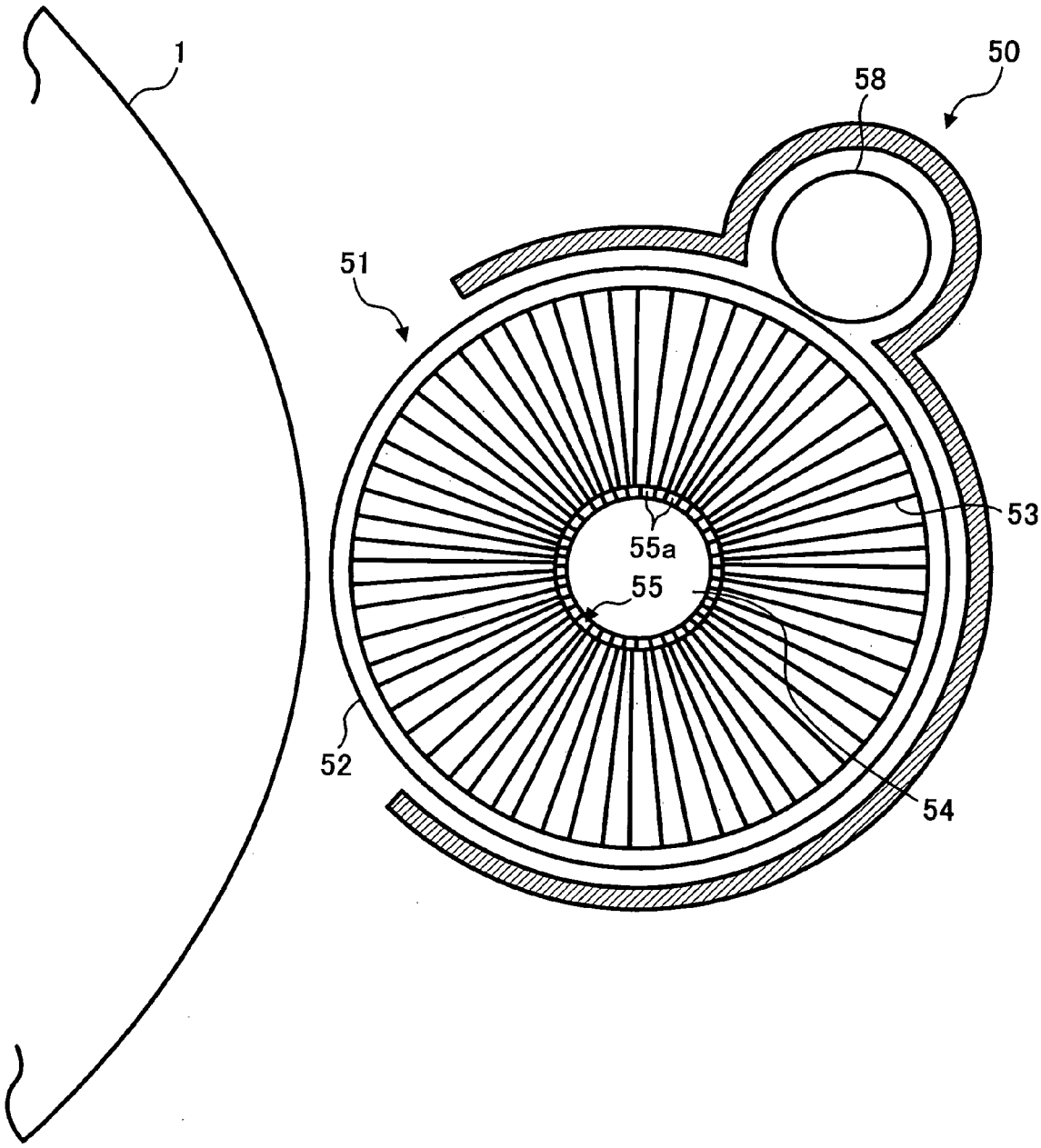
FIG. 9 is a cross section illustrating another example of a developing device of the present invention.

Next, a Variant Example 2 is described. FIG. 9 is a diagram illustrating the developing device 50 of this Example. The developing device 50 includes a fur brush 53 functioning as a charging member in its interior. The fur brush 53 abrasively charges a developer. The developing device 50 further includes a developing roller 51 and a layer thickness regulating member 58 in its casing. The layer thickness regulating member 58 is provided with a gap between the layer thickness regulating member 58 and the developing roller 51. As in the example described above, a suction bias by which the developer is electrostatically transferred from the inner circumference of a developing sleeve 52 to the outer circumference thereof is applied to the layer thickness regulating member 58. A developing roller 51 includes the developing sleeve 52 having the same structure as in the example described above, and the fur brush 53 functioning as a charging member disposed inside the developing sleeve 52. In the center portion of the fur brush 53, a developer holding unit 54 having a hollow center is provided. The developer is supplied from the developer supplying system as described above. A hair planted member 55 including transplanted hair of the fur brush 53 has multiple piercing holes 55*a* extending from the developer holding unit 54 to the outside of the hair planted member 55. The front end of the fur brush 53 is not in contact with the inner circumference of the developing sleeve 52 to prevent leaking of a developing bias applied to the developing sleeve 52 to the fur brush 53. To the hair planted member 55 of the fur brush 53, a suction bias having an opposite polarity to that of the developer and a voltage of 1 to 9 volts, which is smaller than the developing bias in absolute value, is applied to charge the fur brush 53. The fur brush 53 rotates together with the developing sleeve 52 at the same speed by a driving force (not shown). In addition, the fur brush 53 is formed of an electroconductive material.

The slightly charged developer supplied to the toner holding unit 54 is electrostatically transferred to the hair planted member 55 through the piercing holes 55*a* by the electric field applied to the developing sleeve 52. The developer transferred to the hair planted member 55 is electrostatically transferred to the developing sleeve 52 by the electric field between the developing sleeve 52 and the hair planted member 55 formed by the developing bias. In addition, since the suction bias mentioned above is applied to the fur brush 53, the slightly charged developer electrostatically contacts with the fur brush 53 while the developer is transferred. The developer is abrasively charged by contacting with the fur brush 53. The developer abrasively charged during electrostatical transferring to the end of the fur brush 53 is attached to the inner circumference of the developing sleeve 52. Since the developing sleeve 52 and the fur brush 53 are rotating at the same speed, the developer attached to the inner circumference of the developing sleeve 52 can avoid deterioration caused by its mechanical contact with the fur brush 53.

Since a suction bias is applied to the layer thickness regulating member 58, the developer transferred to the inner circumference of the developing sleeve 52 is transferred to the surface of the developing sleeve 52 as described in the embodiment mentioned above. Thereafter the developer is transferred to the developing area to develop an image.

Also in the developing device 50 of Variant Example 2, the developer supplied to the developer holding unit 54 is abrasively charged during electrostatic transferring. Therefore, when the developer is supplied to the surface of the developing roller 51, the developer is sufficiently charged. In addition, since the developer is electrostatically transferred to the surface of the developing roller 51, the developer does not mechanically deteriorate.

VARIANT EXAMPLE 3

Figure 10:
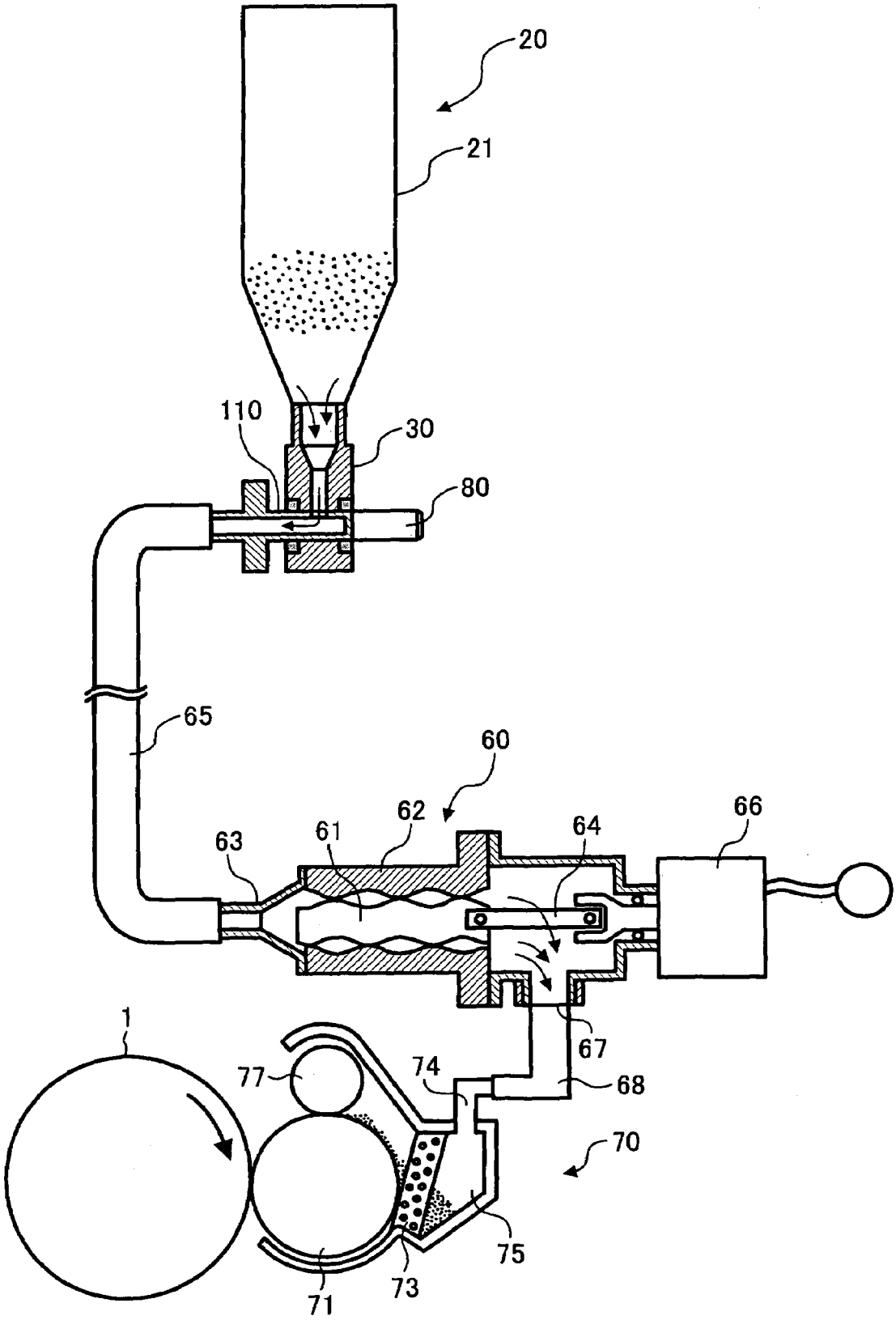
FIG. 10 is a cross section illustrating another example of a developing device of the present invention.
Figure 11:
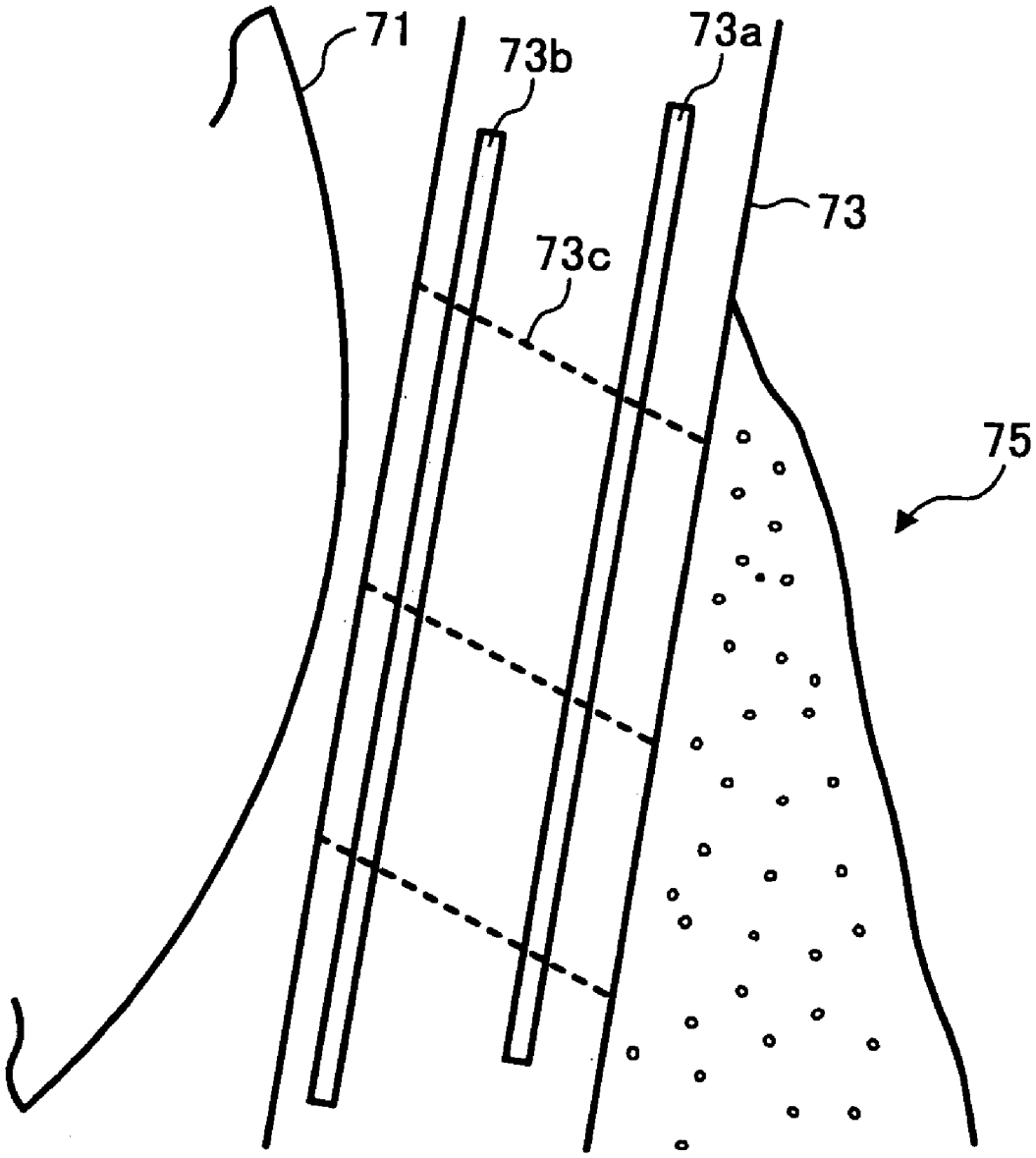
FIG. 11 is a cross section illustrating an example of a developer supplying device of the present invention.

Next, a developing device 70 of a Variant Example 3 is described. FIG. 10 is a diagram illustrating the developing device 70 of Variant Example 3. In the developing device 70, a developer supplying member 73 functioning as a developer supplying system is externally provided to a developing roller 71. The developing device 70 includes the developing roller 71, a developer holding unit 75 holding a developer supplied from a developer replenishing system, and the developer supplying member 73 supplying the developer held in the developer holding unit 75 to the developing roller 71. The developer is replenished in the same manner as illustrated in FIG. 2. The developer supplying member 73 is disposed between the developing roller 71 and the developer holding unit 75. The developer supplying member 73 includes an open cell foam functioning as a charging member. The developer holding unit 75 includes first and second electroconductive plates 73*a* and 73*b* having a mesh form and extending in the vertical direction in FIG. 11 with the same interval, i.e., in a parallel position to each other. Respective transfer biases are applied to these two electroconductive plates 73*a* and 73*b* to electrostatically transfer the developer to the side of the developing roller 71. A first transfer bias is applied to the first electroconductive plate 73*a* provided to the side of the developer holding unit 75. A second transfer bias is applied to the second electroconductive plate 73*b* provided to the side of the developing roller 71. The voltage applied for each of the first and the second transfer bias has a polarity opposite to that of the developer and the voltage applied to the second transfer bias is larger in absolute value than the voltage applied to the first transfer bias. In addition, the developer supplying member 73 is divided by walls 73*c* slantingly provided from the developer holding unit 75 upward to the developing roller 71 as illustrated in the dotted lines in FIG. 11.

In the developing device 70 of Variant Example 3, the developer container 20 replenishes the amount of the developer for use in forming one image at one time. The developer supplied to the developer holding unit 75 is slightly charged by abrasively contacting the developer supplying tube 68. The slightly charged developer in the toner holding unit 75 is electrostatically transferred to the first electroconductive plate 73*a* by the function of the electric field of the transfer bias applied to the first electroconductive plate 73*a*. The developer electrostatically transferred from the developer holding unit 75 to the first electroconductive plate 73*a* contacts with the wall of the open cell and is abrasively charged while the developer is electrostatically transferred to the first electroconductive plate 73*a*. The developer electrostatically transferred to the first electroconductive plate 73*a* is electrostatically transferred to the second electroconductive plate 73*b* by the function of the electric field of the second transfer bias applied to the second electroconductive plate 73*b*. The developer abrasively charged by contacting the wall of the open cell foam while the developer is electrostatically transferred to the second electroconductive plate 73*b* is electrostatically transferred to the side of the developing roller 71 by the developing bias applied to the developing roller 71 in the developer supplying member 73. The developer transferred to the side of the developing roller 71 attaches to the developing roller 71 by the electric filed of the developing bias. The developer attached to the developing roller 71 is regulated by the layer thickness regulating member 77 to form a thin layer having a uniform thickness of 0.4 to 0.8 mg/cm$^2$ based on the unit area and is transferred to the developing area.

In the developing device 70 of Variant Example 3, since the developer is also abrasively charged by contacting the wall of the open cell foam while being transferred to the developing roller 71, the developer is sufficiently charged when the developer is supplied to the surface of the developing roller 70. In addition, the developer is electrostatically transferred to the side of the developing roller 71 so that the developer can avoid mechanical deterioration.

Next, the developer preferably for use in the examples of the present invention is described. It is beneficial for the developer to have a specific form. The developer having an average circularity less than 0.96, which is significantly away from a sphere form, meaning that the developer has an irregular form, may not have a sufficient chargeability. A developer having an average circularity less than 0.96 may not sufficiently spin to be charged when the developer contacts with the wall of an open cell foam. On the contrary, a developer having an average circularity not less than 0.96 spins enough when the developer contacts with the wall of an open cell foam. Therefore, the friction between the developer and the wall is strong, resulting in an increase in the amount of charge in the developer.

The method of measuring the form of a developer is preferably an optical detection band method in which: (1) pass a suspension containing developer particles an image photographing detection belt on a plane board; and (2) optically detect and analyze the particle image with a CCD camera. The circularity is defined by the following relationship: Circularity=(the circumferential length of the circle having the area equal to a projected developer area/the circumferential length of the projected developer area). The average circularity is measured and calculated using a flow type particle image analyzer FPIA-2000 (manufactured by Sysmex Corporation). A specific measuring method is as follows: (1) add to 100 to 150 ml of water from which impurities have been removed and a surface active agent as a dispersant, preferably 0.1 to 0.5 ml of alkyl benzene sulfonate; (2) add 0.1 to 0.5 g of a target sample to the resultant dispersion liquid; (3) disperse the suspension in which the target sample is dispersed for about 1 to about 3 minutes with a supersonic dispersion device; and (4) measure the form and the distribution of the developer with the device mentioned above with a dispersion liquid density of 3,000 to 10,000 particles/μl to obtain its average circularity.

The method of manufacturing the developer having an average circularity of from 0.96 to 1.00 suitably used in the examples of the present invention is described next. To be clearly understood, the method is described comparing the method of manufacturing a common toner.

Preparation of a Common Toner:

After fully mixing the materials below with a HENSCHEL mixer, the mixture is melted and kneaded at 150° for two hours with a small-sized two roll mill.

| | |
|---|---|
| Binder resin (styrene-methylacrylate copolymer) | 100.0 parts by weight |
| Colorant (Carbon black #44, manufactured by Mitsubishi Chemical Corporation) | 10.0 parts by weight |
| Charge controlling agent (zink salt of ditertiarybutyl salicylic acid) (BONTRON E-84 manufactured by Orient Chemical Industries, Ltd.) | 2.0 parts by weight |
| Carnauba wax | 5.0 parts by weight |

After coarsely pulverizing the resultant mixture with a pulverizer mounting a screen of 2 mm, pulverize the resultant with a labo JET (a mini-type super sonic jet mill) and classify the resultant with 100MZR (a classifier) to obtain colored particles having a diameter of from 4 to 10 μm. Mix 3 parts by weight of silica and 2 parts of weight of titan particles functioning as additives to improve developability, transferability, cleanability, and chargeability of a toner (average diameter of both additives is 20 nm) based on 95 parts by weight of the obtained colored particles with a HENSCHEL mixer for two minutes. Filtrate the mixture to obtain a common toner. This is how a common toner is manufactured. The average circularity of the common toner measured using a flow type particle image analyzer FPIA-2000 (manufactured by Sysmex Corporation) is 0.93. The common toner has a weight average particle diameter of 5.73 μm.

Preparation of the Developer for Use in the Examples

The colored particles obtained from the process of manufacturing the common toner is treated by a Surfusion System manufactured by Nippon Pneumatic Mfg Co., Ltd. twice under the condition that the heat treatment temperature is 250° C., the amount of heat wind is 1,000 litter/min, and the amount of supplying wind is 100 litter/min to obtain colored particles having a diameter of from 4 to 10 μm. Mix 3 parts by weight of silica and 2 parts of weight of titan particles functioning as additives to improve developability, transferability, cleanability, and chargeability of a developer (average diameter of both additives is 60 nm) based on 95 parts by weight of the obtained colored particles with a HENSCHEL mixer for two minutes. Filtrate the mixture to obtain a new developer. The new developer has a circularity of 0.96 and the weight average particle diameter of 5.56 μm.

As mentioned above, a developer having a circularity not less than 0.96 can be obtained when a pulverized developer is subject to heat treatment. In addition, instead of using the heat treatment method, a developer having a circularity not less than 0.96 can also be obtained by a mechanical method in which, for example, a turbo mill (manufactured by Turbo Kogyo Co., Ltd.) as described in JOP 9-85741, KRIPTRON (manufactured by Kawasaki Heavy Industries, Ltd.) or Q type mixer (manufactured by Mitsui Mining Co., Ltd.) is used. Additionally, such developers can be manufactured by wet granulating methods such as suspension polymerization methods, dispersion polymerization methods, and dissolution suspension methods. These methods have an advantage in terms of energy efficiency.

Figure 12:
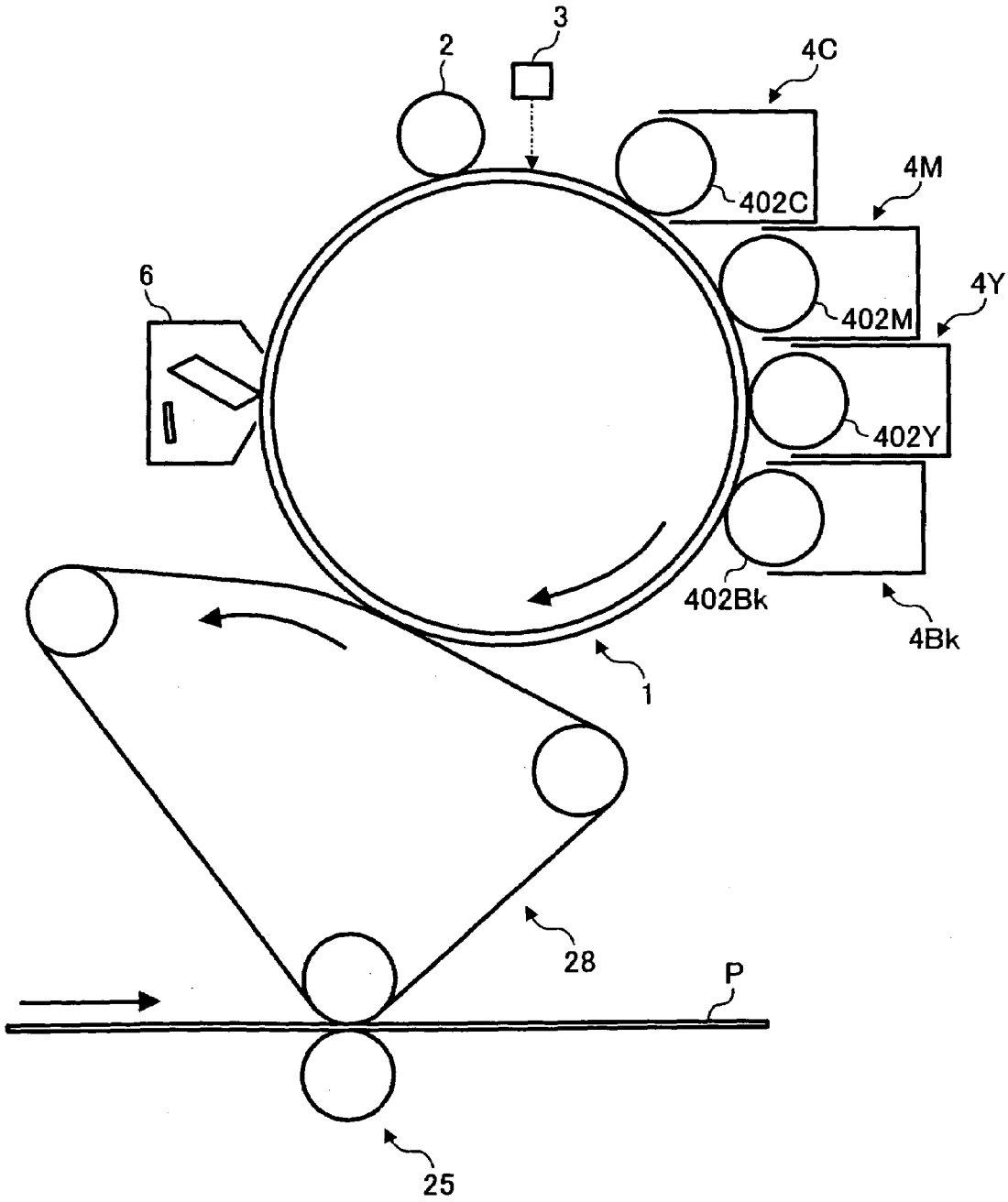
FIG. 12 is a diagram illustrating an example of an image forming apparatus of the present invention having an intermediate transfer body.
Figure 13:
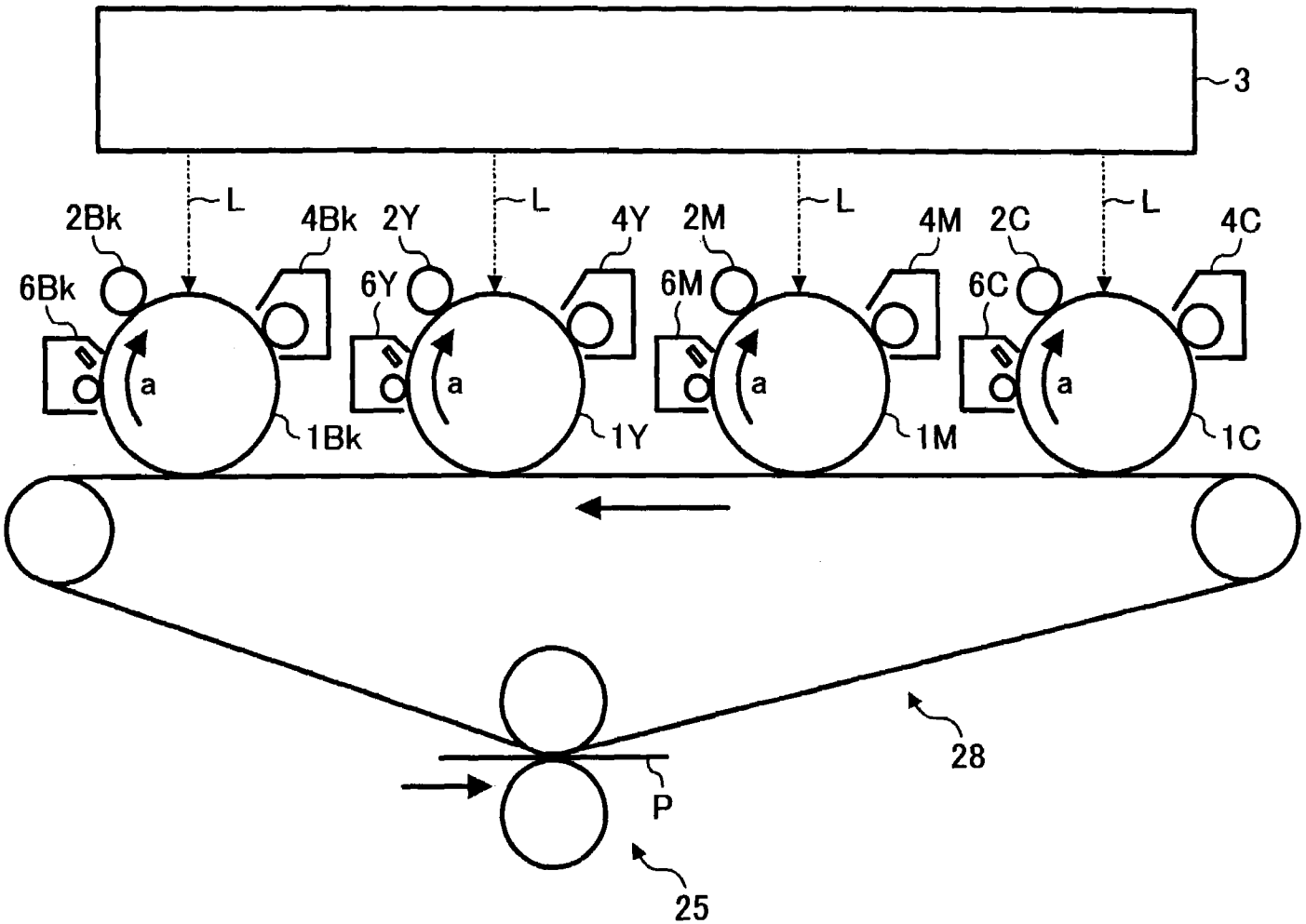
FIG. 13 is a diagram illustrating an example of a tandem type image forming apparatus of the present invention.

In the examples described above, the method described is that a developed image formed on the photoreceptor drum 1 is directly transferred to the recording material P. In addition, the present invention can be applied to a method in which a developed image on the photoreceptor drum 1 illustrated in FIGS. 12 and 13 is temporarily transferred to an intermediate transfer body, i.e., an intermediate transfer belt 28 in this case, and thereafter the developed image on the intermediate transfer belt 28 is transferred to the recording material P. The image forming apparatus illustrated in FIG. 12 forms a developed image of each color on a single photoreceptor drum 1 and each color developed image on the photoreceptor drum 1 is overlapped on the intermediate transfer belt 28 by a primary transfer device. The overlapped developed image on the intermediate transfer belt 28 is transferred to the recording material P by a secondary transfer device 25. In FIGS. 12 and 13, characters C, M, Y and Bk, which are put at the back of the numerals such as 2 and 4, represent colors of cyan, magenta, yellow and black, respectively and each has the same structure as those illustrated in FIG. 1.

This document claims priority and contains subject matter related to Japanese Patent Application No. 2004-195003, filed on Jun. 30, 2004, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claim as new and desired to be secured by Letters Patent of the United States is:

1. A developer supplying device, comprising:

a developer holding unit configured to hold a developer;

a developer transfer device configured to electrostatically transfer the developer from the developer holding unit; and a charging member having plural holes piercing therethrough from the developer holding unit, configured to abrasively charge the developer by contacting the developer with walls of the plural holes while the developer is electrostatically transferred through the plural holes by the developer transfer device.

2. The developer supplying device according to claim 1, wherein the charging member has a roller form, and the developer holding unit and the developer transfer device are provided internally to the charging member.

3. The developer supplying device according to claim 2, further comprising a rotation device configured to rotate the charging member.

4. The developer supplying device according to claim 1, wherein the developer is supplied to the developer holding unit by a powder pump.

5. The developing device according to claim 1, wherein the developer comprises a toner having an average circularity of from 0.96 to 1.0.

6. The developer supplying device according to claim 1, wherein the charging member is an open cell foam in which the cells disposed internally to the charging member are linked to each other.

7. The developer supplying device according to claim 6, wherein the number of the open cells in the open cell foam is from 6 to 23 cells/25 mm.

8. The developer supplying device according to claim 6, wherein a ratio (dm/dt) of a diameter (dm) of the plural holes to a diameter (dt) of the developer is greater than 100.

9. The developer supplying device according to claim 6, further comprising partitions separating the open cell foam such that the partitions radially extend from the developer holding unit.

10. The developer supplying device according to claim 6, wherein the open cell foam is formed of an electroconductive member.

11. A developing roller, comprising:

a developer supplying device configured to supply a developer, comprising:

a developer holding unit configured to hold the developer;

a developer transfer device configured to electrostatically transfer the developer from the developer holding unit; and a charging member having plural holes piercing therethrough, configured to abrasively charge the developer by contacting the developer with walls of the plural holes while the developer is electrostatically transferred through the plural holes by the developer transfer device; and one of a development layer and a sleeve located overlying the charging member, configured to receive the developer electrostatically transferred through the charging member.

12. A developing device, comprising:

a developing roller;

a developer supplying device configured to supply a developer, comprising:

a developer holding unit configured to hold the developer;

a developer transfer device configured to electrostatically transfer the developer from the developer holding unit; and a charging member having plural holes piercing therethrough, configured to abrasively charge the developer by contacting the developer with walls of the plural holes while the developer is electrostatically transferred through the plural holes by the developer transfer device; and a layer thickness regulating member configured to regulate a thickness of a developer layer on the developing roller.

13. The developing device according to claim 12, wherein the charging member has a roller form and is provided internally to the developing roller, and the developer holding unit and the developer transfer device are provided internally to the charging member, and the developing roller further comprises one of a development layer and a sleeve located over lying the charging member, configured to receive the developer electrostatically transferred through the charging member.

14. An image forming apparatus, comprising:

an image bearing member configured to bear a latent electrostatic image thereon;

a charging member configured to charge the image bearing member;

an irradiator configured to irradiate the image bearing member to form the latent electrostatic image on the image bearing member;

a developing device configured to develop the latent electrostatic image with a developer, comprising:

a developing roller;

a developer supplying device configured to supply a developer, comprising:

a developer holding unit configured to hold the developer;

a developer transfer device configured to electrostatically transfer the developer from the developer holding unit; and a charging member having plural holes piercing therethrough, configured to abrasively charge the developer by contacting the developer with walls of the plural holes while the developer is electrostatically transferred through the plural holes by the developer transfer device;

a layer thickness regulating member configured to regulate a thickness of a developer layer on the developing roller;

a transfer device configured to transfer the developed image to a recording material; and a cleaning device configured to remove residual toner on the image bearing member.

15. A process cartridge, comprising:

an image bearing member configured to bear a latent electrostatic image thereon; and a developing device configured to develop the latent electrostatic image borne on the image bearing member, comprising:

a developing roller;

a developer supplying device configured to supply a developer, comprising:

a developer holding unit configured to hold the developer;

a developer transfer device configured to electrostatically transfer the developer from the developer holding unit; and a charging member having plural holes piercing therethrough, configured to abrasively charge the developer by contacting the developer with walls of the plural holes while the developer is electrostatically transferred through the plural holes by the developer transfer device; and a layer thickness regulating member configured to regulate a thickness of a developer layer on the developing roller.

16. A developer supplying device, comprising:

means for holding a developer;

means for electrostatically transferring the developer from the developer means for holding; and means for charging having plural holes piercing therethrough from the means for holding, for abrasively charging the developer by contacting the developer with walls of the plural holes while the developer is electrostatically transferred through the plural holes by the means for electrostatically transferring.

17. The developer supplying device according to claim 16, wherein the means for charging has a roller form, and the means for holding and the means for electrostatically transferring are provided internally to the means for charging.

18. The developer supplying device according to claim 17, further comprising means for rotating the means for charging.

19. The developer supplying device according to claim 16, wherein the developer is supplied to the means for holding by a powder pump.

20. The developing device according to claim 16, wherein the developer comprises a toner having an average circularity of from 0.96 to 1.0.

21. The developer supplying device according to claim 16, wherein the means for charging is an open cell foam in which the cells disposed internally to the means for charging are linked to each other.

22. The developer supplying device according to claim 21, wherein the number of the open cells in the open cell foam is from 6 to 23 cells/25 mm.

23. The developer supplying device according to claim 21, wherein a ratio (dm/dt) of a diameter (dm) of the plural holes to a diameter (dt) of the developer is greater than 100.

24. The developer supplying device according to claim 21, further comprising means for separating the open cell foam such that the means for separating radially extend from the means for holding.

25. The developer supplying device according to claim 21, wherein the open cell foam is formed of an electroconductive member.

* * * * *